US005445004A

United States Patent [19]

Nannini et al.

[11] Patent Number: 5,445,004

[45] Date of Patent: Aug. 29, 1995

[54] EXTRUSION METHOD WITH GAS EVACUATION, AND EXTRUSION PRESS

[75] Inventors: Leandro Nannini, Milan; Franco Libera, Sesto San Giovanni, both of Italy

[73] Assignees: Breda Danieli Extrusion; Forging Presses Spa, both of Milan, Italy

[21] Appl. No.: 157,211

[22] Filed: Nov. 24, 1993

[51] Int. Cl.[6] ..... B21C 27/00

[52] U.S. Cl. ..... 72/272

[58] Field of Search ..... 72/253.1, 272

[56] References Cited

U.S. PATENT DOCUMENTS 2,822,087 2/1958 Lorant ..... 72/272

3,867,828 2/1975 Kent et al. ..... 72/272

FOREIGN PATENT DOCUMENTS 0397473 11/1990 European Pat. Off. .

531612 3/1993 European Pat. Off. ..... 72/253.1

*Primary Examiner*—Lowell A. Larson

*Attorney, Agent, or Firm*—Young & Thompson

[57] ABSTRACT

In a billet-fed extrusion press, the movement of the container towards and against the die contained in the die slide at the beginning of an extrusion operation is opposed by auxialiary jacks (40), which maintain a gap of small thickness between the container and the die, so as to allow the escape of gas, until a predetermined thrust onto the container itself is reached.

8 Claims, 4 Drawing Sheets

EXTRUSION METHOD WITH GAS EVACUATION, AND EXTRUSION PRESS

FIELD OF THE INVENTION

The present invention refers to the field of extrusion presses.

BACKGROUND OF THE INVENTION

Particular reference will be made below to extrusion presses fed with billets, usually aluminium billets, although it is understood that the invention can be applied to other types of presses also.

The extrusion presses for billets known at present comprise a fixed cylinder on a fixed base, inside of which cylinder a ram or main piston is movable. A movable cross member is integral with the ram, and usually guided along the base, and carries a stem extending along the extrusion axis. On the same base or another base a fixed cross member is mounted, which carries a die slide, and in the die slide various dies can be interchanged.

A so-called container having a through chamber for the billet, is movable on the base along the extrusion axis between a working position, in which it is in a sealed or tight manner against a die contained in the die slide, and a rest position, in which it is at a distance from the box which is sufficient for the passage of a shears blade moving transversely to the extrusion axis. The container is moved by cylinders located on the fixed cross member.

The presses so briefly described operate in the following manner. With the container positioned in an airtight or sealed manner against the die slide complete with a die, a billet at a suitable temperature, which has been carried onto the extrusion axis in any way whatsoever upstream of the container, is first introduced into the container and then pressed against and through the die by means of the stem; the stem moves back at the end of its run and the container is moved away from the die by the cylinders of the container, in such a way that the shears can intervene for separating the produced profile or section from the remaining part of the billet, known as the butt or scrap.

The process for preparing a press for extruding a certain quantity of aluminium alloy often leads to air being trapped in the bore of the container, before the alloy being subjected to extrusion pressure. The air is pressurized by the extrusion process and causes serious damage to the finish of the product, in the form of blisters, often accompanied by characteristic noises made by the air when it expands in the atmosphere after passing through orifices.

A standard cycle for an extrusion process, with the aim of eliminating the problem of trapped air, is called a degassing or "burp" cycle, or pre-pressing cycle, etc. According to this cycle, the aluminium alloy is compacted in the container (positioned against the die) at a pressure equal to or lower than half of the pressure required for extrusion. Such operation is called upsetting of the billet. Then the members which usually are on load during extrusion are released, that is to say, the ram, the stem, the container and the die; in other words, these members are physically moved so as to break the sealed or airtight engagement around the die, allowing air to escape. The cycle which includes degassing is then completed by closing the container once more against the die until a sealed or airtight engagement is obtained, while the main ram reassumes the position for the beginning of the extrusion.

The above described process requires a certain time lapse (5–6 seconds) for inverting the movement of the members; this reduces the productivity of the press.

A method for avoiding the loss of time inherent in the degassing cycle is the object of European Patent application No. 90305003. 7; this method comprises removing air from the container by connecting a vacuum-creating system to the container itself. An air suction or vacuum line is made in the stem of the press, the stem having a pressure head or pad movable between a position in which it frees an aperture of the vacuum line and a position where it closes it. The equipment, however, for realizing such method is very expensive.

SUMMARY OF THE INVENTION

The aim of the present invention is to remove air from the container with a different method from the one realized by the "degassing cycle", and which does not require the use of an expensive system for creating a vacuum.

The invention consists of an extrusion method for extruding a billet contained in a container through an extrusion die in a die slide, under the action of a stem and an extrusion press for carrying out the method. The method consists in a new cycle which involves a temporary stop in the movement of the container in the step when the latter is brought to sealing or airtight engagement against the die. In such way, a ring-shaped gap remains between the container and the die. When the aluminium alloy compacting step takes place under the action of the stem, the billet swells until against the wall of the container bore, and air which is in the container escapes through the gap. The axial force exerted by the stem is transmitted to the container by friction, and when this friction force has reached a predetermined value, the container moves into the airtight or sealed position.

The press comprises a supplementary single-acting cylinder or jack applied to a closure cap of each container operating cylinder; the piston rod of the supplementary cylinder acts in opposition to the container movement piston rod.

The invention allows the gas in the container to be removed with a reduced time cycle compared with the "burp" cycle, and with equipment which is definitely less expensive when compared with the prior art equipment mentioned above.

BRIEF DESCRIPTION OF THE DRAWINGS

A description of an exemplary embodiment is .given below, with reference to the appended drawings, in which.

DETAILED DESCRIPTION OF THE INVENTION

Figure 1:
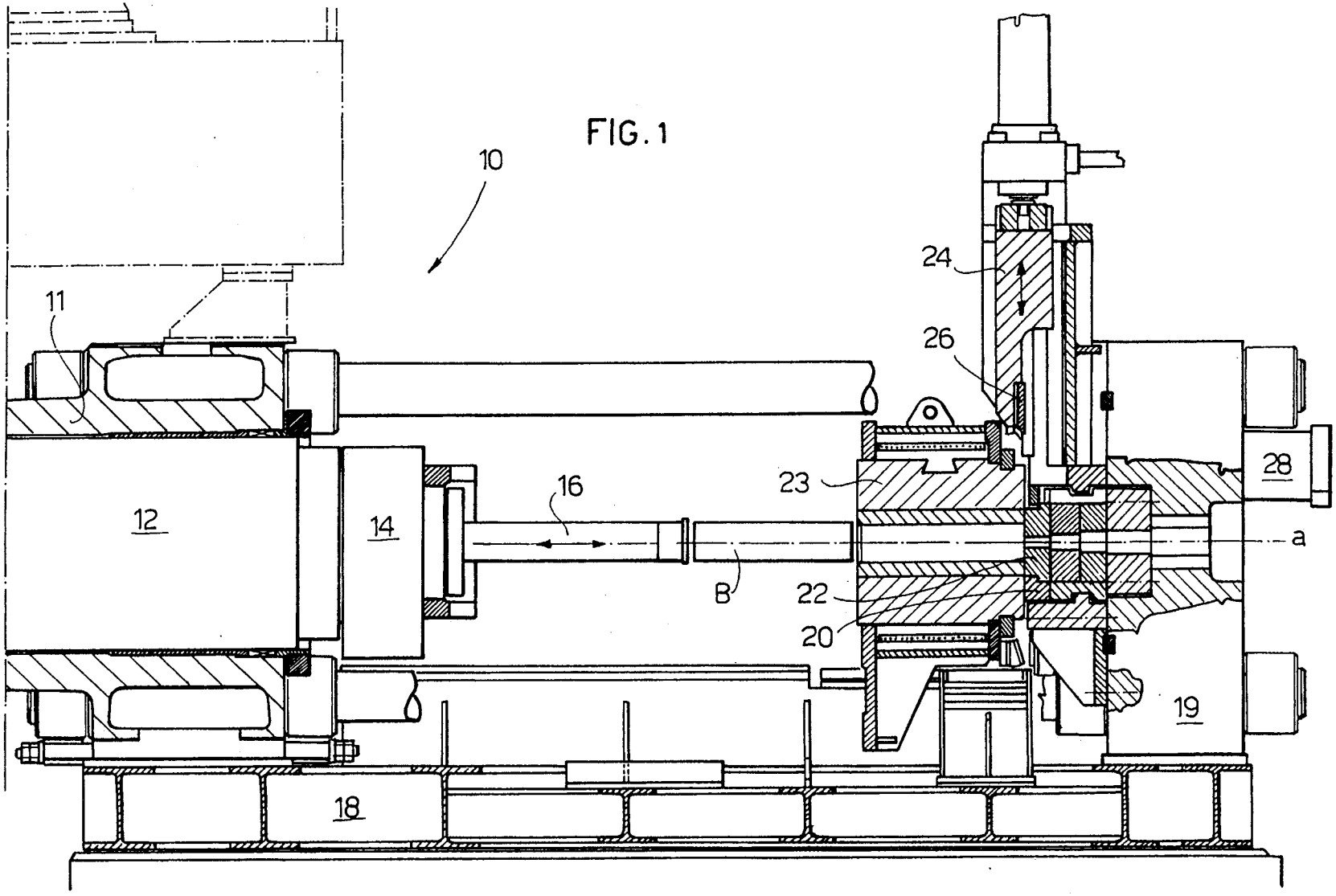
FIG. 1 is a longitudinal part-sectional view along the extrusion axis of a prior art press drawn at a reduced scale.
Figure 2:
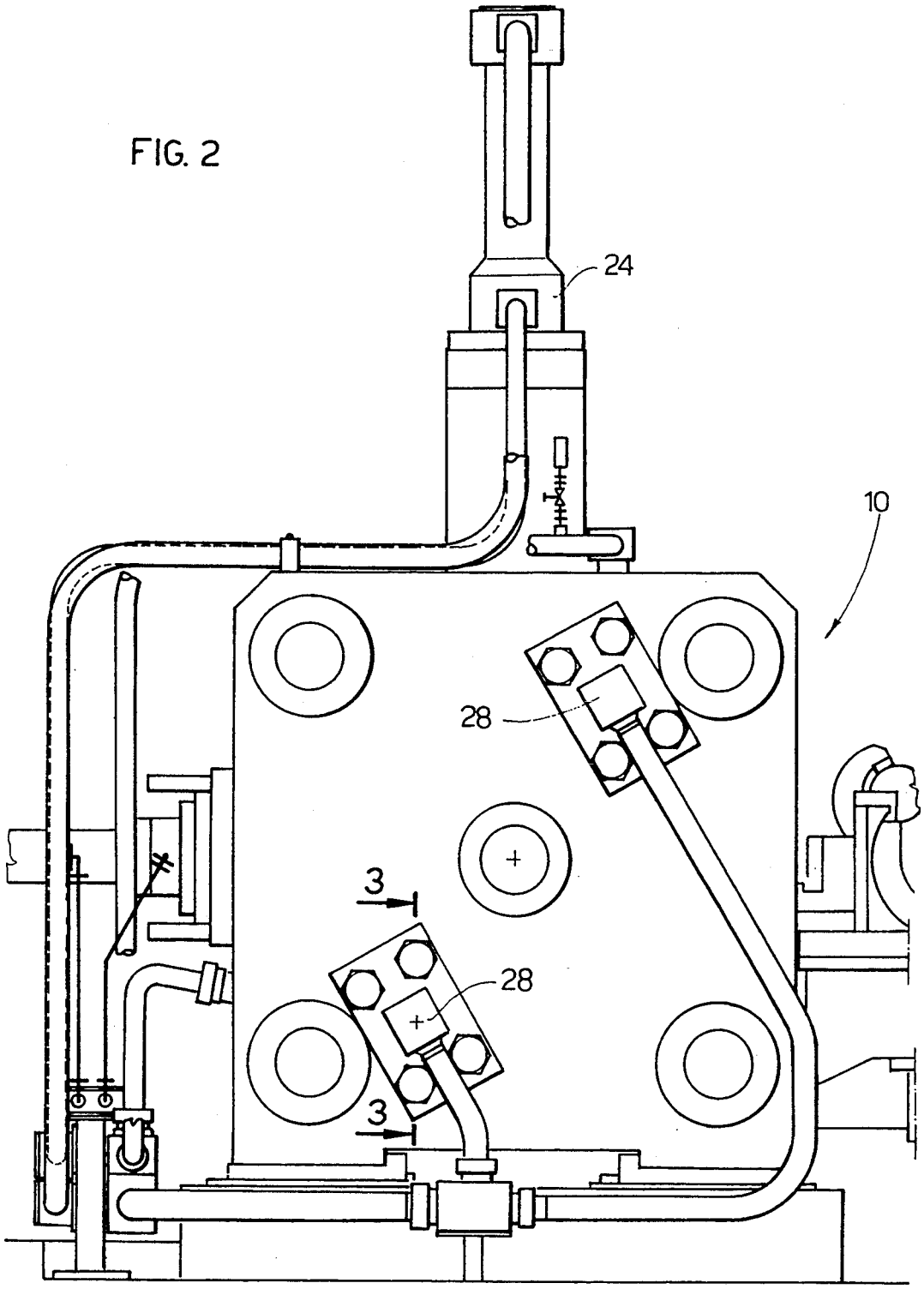
FIG. 2 is a view from the right with respect to FIG. 1.

A press 10, in FIG. 1 comprises a cylinder 11 inside which a ram 12 is movable, which carries a movable cross member 14. This in turn carries a stem 16 aligned along extrusion axis a. On the same base 18 which carries the cylinder a fixed cross member is mounted, which carries a die slide 20, in which extrusion dies 22 are interchangeable. A container 23 is supported and slidable for a length along the axis a between a work position, in FIGS. 1 and 3, in which it is in sealed or airtight engagement against a die, and a rest position, in which it is spaced from the die slide by a distance which is sufficient to allow the movement of shears 24 with a blade 26 transverse to axis a. The movement of the container is brought about by a pair of cylinders 28 and 28 (FIGS. 2 and 3) fixed to the cross member 19, whose axes are parallel to and coplanar with axis a. Reference B is a billet, positioned in any way whatsoever along the extrusion axis a, and about to be pushed into the container and extruded by means of the stem 16.

Figure 3:
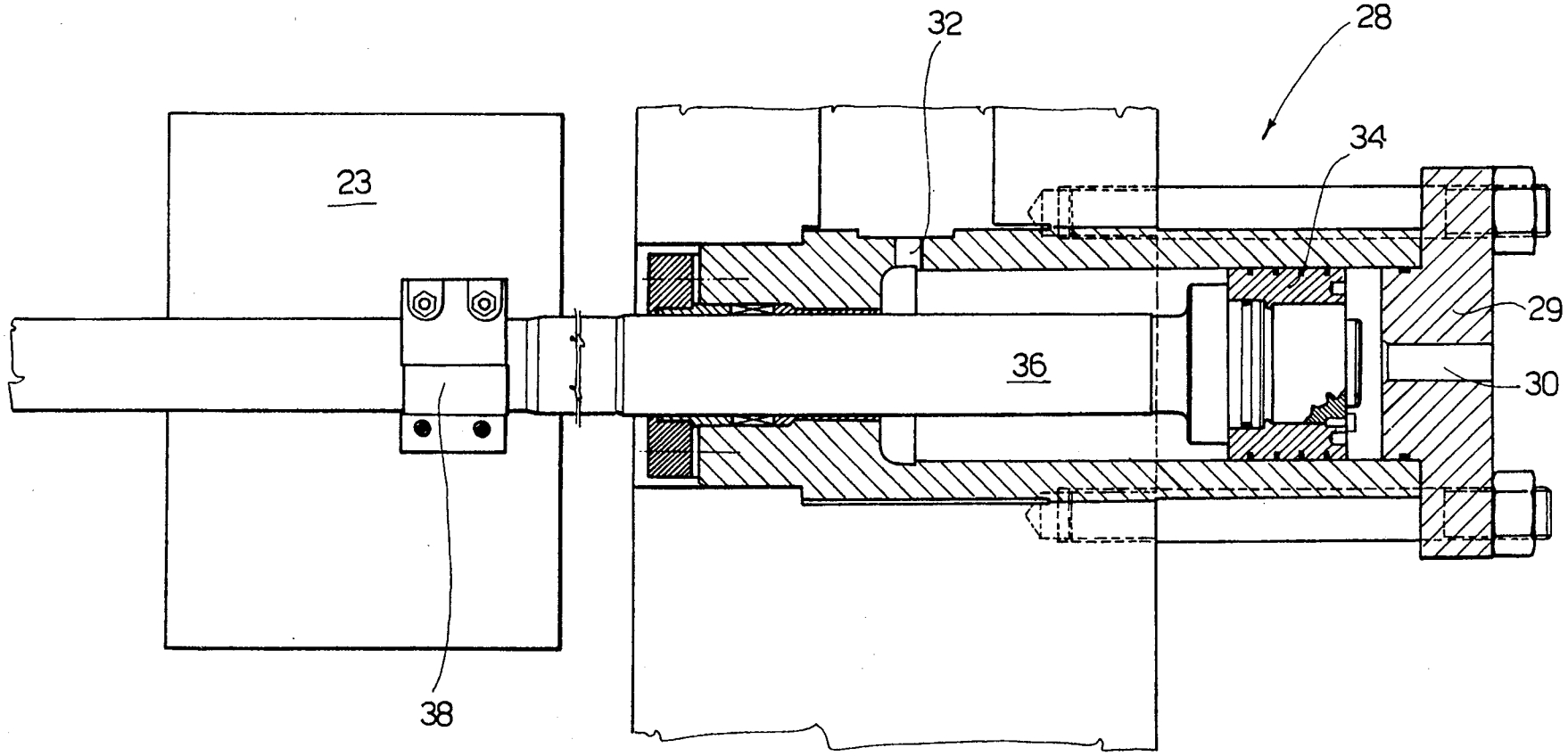
FIG. 3 is a longitudinal part-sectional view of a prior apparatus, taken along 3—3 in FIG. 2 and enlarged with respect to said Figure, i.e. in a plane containing the axis of one of the container movement cylinders.

FIG. 3 shows a sectional view of one of the said cylinders 28 in a plane containing its axis. The cylinder is a double-acting cylinder closed with a cap 29 having a passage or hole 30 for oil or other working fluid. A further hole or passage 32 for working oil is located in the chamber opposite to the passage 30. A piston 34 is movable inside cylinder 28 and is integral with a piston rod 36, fastened with brackets 38 to the container 23.

As it is clear, pressurized oil admitted through the hole 30 moves the container away from the die; pressurized oil admitted through the hole 32 moves the container near to the die until sealing it against the latter.

Figure 4:
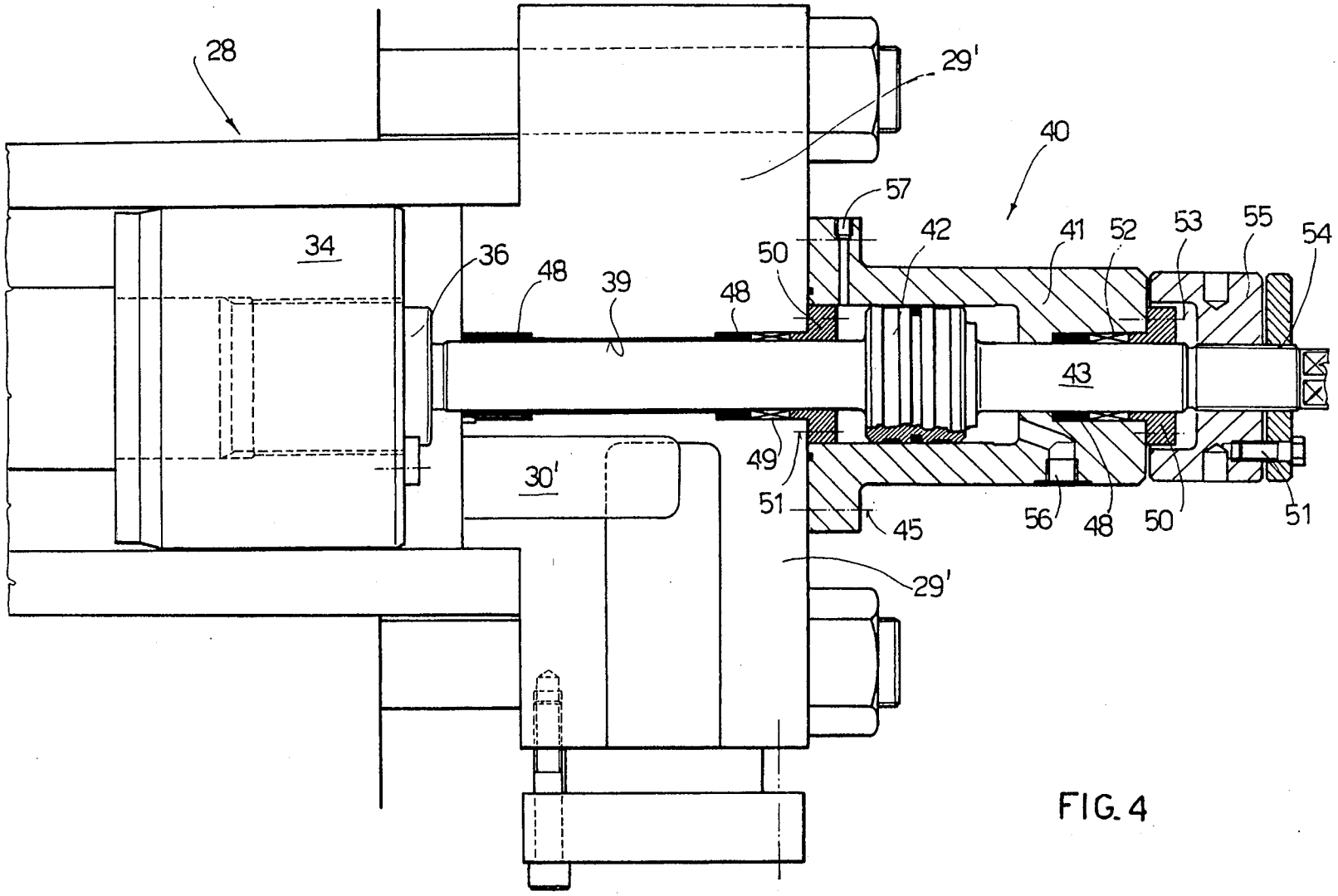
FIG. 4 is a section similar to the one in FIG. 3, which shows an apparatus according to the present invention.

In the description of FIG. 4, which shows the apparatus of the present invention in detail, the same reference numerals will be kept as in FIG. 3 for parts which are identical. In FIG. 4 an end of the operating and sealing cylinder 28 is seen, precisely the end opposite to the container. In the cylinder 28 the piston 34 is movable, having a piston rod 36 integral with it; the left-hand parts of FIG. 4 are not shown since they are of the known type.

The cylinder 28 is closed with a cap 29', which has a housing 39 along the axis thereof and an off-set hole 30' for letting in oil (or other working fluid). An auxiliary hydraulic jack, referenced 40, is applied onto the cap of the container operating cylinder 28. This jack consists of a cylinder 41 inside which a piston 42 is slidable, which is ant integral part of a piston rod 43, which extends on both sides of the piston.

The cylinder 41 is joined by means of screws. 45 to the cap 29' of the operating cylinder for the container. The rod 43 is received into the housing 39 through the cap until against piston 34 (or against a rod integral therewith) of the cylinder 28 for moving the container.

The rod 43 is guided by two bushes 48.

The seal around the piston rod is ensured by a gasket packing 49 held in place by a stuffing flange 50, fastened to the cap by screws 51. On the other side, the piston rod passes through a bottom part of the cylinder 41; the sealing to the oil operating the jack is obtained with a gasket pack 52 held in place by a stuffing flange 53. An end part of piston rod 43 has a thread 54 on which a cup element 55 is screwed, acting as a mechanical stop for the piston stroke.

By rotating the cup 55 it is possible to regulate the piston stroke with precision.

The oil for operating the jack is fed in through the hole 56, while, since the piston 42 is a single-acting piston, the hole 57 connects the annular downstream chamber of the piston with the atmosphere.

The jacks, one for every cylinder of the container, when they are pressurized, prevent the complete closure of the container, creating between container and die a gap for air trapped in the container to escape.

The force transmitted by friction to the container increases as the contact surface between billet and container bore increases. When this force exceeds the thrust exerted by the jacks, the container moves to sealing position against the die.

In order to obtain this effect, a suitably calibrated discharge valve (not illustrated) at predetermined pressure discharges oil from the auxiliary jack chamber and therefore allows the closure of the container.

We claim:

1. An extrusion method for extruding a billet in an extrusion press, with gas ejection, the extrusion taking place through an extrusion die, comprising the steps of:

introducing the billet into a container which is movable towards and against the extrusion die and away from the extrusion die along an extrusion axis:

applying on the billet a stem which is movable along the extrusion axis towards an inside the container and towards and away from the die;

temporarily stopping movement of the container thereby leaving a gap between the container and the die for air ejection;

moving the stem inside the container towards the die in order to upset the billet;

obtaining at least a beginning of upsetting of the billet in the container;

applying to the container a force due to fluid pressure opposite to a frictional force transmitted by the stem to the container through the billet which is being upset; and moving the container towards the die and in a sealing position against the die under a resulting force applied to the container, said resulting force comprising the force due to fluid pressure applied to the container, and the frictional force transmitted to the container by the stem through the billet which is being upset.

2. A method according to claim 1, wherein said force due to fluid pressure is applied on the container by jacks connected to a rod of cylinders operating movement of the container.

3. A method according to claim 1, wherein said force due to fluid pressure is adjustable.

4. A method according to claim 1, wherein when the container is temporarily stopped, the gap is sufficiently small to eject air, but not to let the billet escape.

5. A method for extruding a billet through an extrusion die inside an extrusion press with gas ejection, the press comprising a billet container which is movable towards, against, and away from the extrusion die along an extrusion axis, said container being provided with container cylinders, a stem movable along the extrusion axis towards and inside the container and towards and away from the die; said method comprising the steps of a) applying a fluid pressure on the stem in a direction towards the die, when the stem is in contact with the billet contained inside the container;

b) while the pressure is being applied on the stem, applying a fluid counterpressure on jacks connected with respective cylinder rods of the container, opposite to the first pressure, so as to oppose said pressure on the stem and maintain the container at a small gap from the die for air ejection through said gap;

c) determining at least a start of billet upsetting in the container; and d) moving the container towards the die and in a sealing position against the die under a resulting force applied to the container, said resulting force comprising the pressure applied to the container and a frictional force transmitted to the container by the stem through the billet which is being upset.

6. An extrusion press for the extrusion of billets comprising:

a die slide for holding an extrusion die;

a billet container which is movable between a position against said die slide or die and a position spaced from said die slide or die;

an extrusion stem cooperating with said container for extruding the billet;

cylinders mounted on a fixed part of the press for operating movement of the container;

means for gas ejection comprising an auxiliary jack on each cylinder operating the container, a piston rod on each auxiliary jack acting in opposition on a movable member of the cylinder operating the container.

7. A press according to claim 6, further comprising means for adjusting the piston stroke of the auxiliary jacks.

8. A press according to claim 7, wherein said adjusting means comprise a thread on which a cup element is screwed.

* * * * *